United States Patent [19]

Huser

[11] 4,371,766

[45] Feb. 1, 1983

[54] PUFFER INTERRUPTER WITH TWO-PIECE INTERRUPTER CONTACT

[75] Inventor: Guido Huser, Birmenstorf, Switzerland

[73] Assignee: BBC Brown, Boveri & Company Limited, Switzerland

[21] Appl. No.: 199,740

[22] Filed: Oct. 23, 1980

[30] Foreign Application Priority Data

Oct. 25, 1979 [CH] Switzerland ..... 9576/79

[51] Int. Cl.[3] ..... H01H 33/88

[52] U.S. Cl. ..... 200/148 A

[58] Field of Search ..... 200/148 A, 148 R

[56] References Cited

U.S. PATENT DOCUMENTS 4,052,577 10/1977 Votta ..... 200/148 A 4,229,627 10/1980 Rostron ..... 200/148 A

FOREIGN PATENT DOCUMENTS 2273362 12/1975 France ..... 200/148 A

*Primary Examiner*—Robert S. Macon

*Attorney, Agent, or Firm*—Ostrolenk, Faber, Gerb & Soffen

[57] ABSTRACT

A puffer interrupter is disclosed having a two-part movable arcing contact assembly which is connected together through a lost motion connection. A relatively light movable arcing contact makes final engagement with a stationary arcing contact without bounce.

5 Claims, 1 Drawing Figure

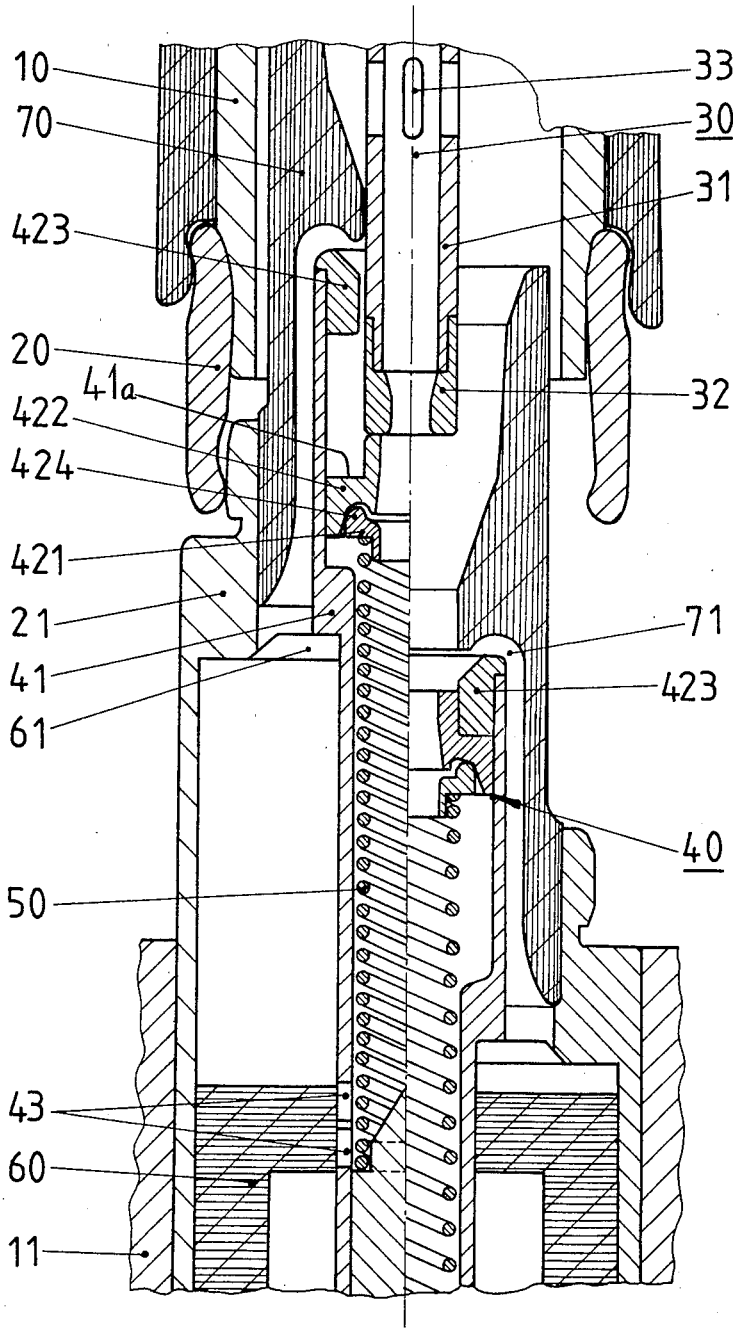
10
70
423
20
41a
422
424
421
21
41
61
50
43
60
11
33
30
31
32
71
423
40

PUFFER INTERRUPTER WITH TWO-PIECE INTERRUPTER CONTACT

BACKGROUND OF THE INVENTION

This invention relates to high voltage circuit interrupters, and more specifically relates to a puffer-type circuit interrupter employing a novel two-piece movable arcing contact.

Puffer-type interrupters are well known and a typical interrupter-type device is shown in Brown Boveri Mitt. 64, 1977 (11), page 629, FIG. 2.

In puffer-type interrupters such as that shown in the above disclosure, a movable assembly consisting of an insulation nozzle and a movable arc contact must be moved together during the opening and closing operations of the interrupter. Since the arcing contact assembly is a single assembly, its entire mass must be moved during the opening and closing operations. During the closing operation, the movable contact comes to an abrupt stop when it engages the stationary contact. Since the arcing contact assembly is relatively massive, there is an undesirable contact bounce following the abrupt stop. Furthermore, since the entire mass of the arcing contact assembly must be accelerated during the opening operation, high operating force is required to obtain a given speed of separation of the contacts.

BRIEF SUMMARY OF THE INVENTION

In accordance with the present invention, the arcing contact assembly is made of a two-piece arrangement connected together by a lost motion-type connection. During contact closing, only one relatively low mass contact portion of the assembly actually engages and has its motion stopped by a cooperating stationary arcing contact. Since the mass of the abruptly stopped decelerated contact element is reduced, contact bounce is drastically reduced and, in some instances, is completely avoided. The other part of the movable arcing contact is disposed to precede the motion of the arcing contact element during closing and to receive the arc root of the arc produced immediately prior to contact closing and after contact opening. This second part of the arcing assembly is free of mechanical friction relative to the stationary arcing assembly and need not come to an abrupt stop during contact closing.

The novel two-piece arcing contact assembly of the invention reduces the energy needed from an operating mechanism for opening the contacts. Moreover, only a relatively small mass is accelerated during the opening operation and prior to the connection of the two parts through their lost motion connection, so that extremely high initial separation speed can be obtained.

Consequently, the novel invention produces a puffer-type circuit breaker configuration which can be easily maintained, is free of closing contact bounce, and reduces the operating force needed moving the moving arcing contact assembly.

BRIEF DESCRIPTION OF THE DRAWING

The drawing shows a longitudinal section through the center of an elongated cylindrically configured puffer-type interrupter employing the present invention wherein the section to the left of the center line shows the parts in their engaged position while the section to the right of the center line shows the parts in their disengaged position.

DETAILED DESCRIPTION OF THE DRAWING

Referring now to the drawing, there is schematically illustrated a puffer-type interrupter which can be employed in a high voltage, high current circuit breaker as is well known to those skilled in the art.

The puffer interrupter employs main conductive stationary terminals 10 and 11 which are suitably fixed relative to a gas-filled enclosure which can be filled with a gas, such as sulfur hexafluoride, at any suitable relatively low pressure, for example, at 3 atmospheres.

A cylindrical main stationary contact 20 is connected to the terminal 10. Contact 20 may be a cluster of separate contact fingers encircled by suitable garter springs which press the contact elements into engagement with member 10 in the usual manner.

Stationary contact 20 cooperates with main movable contact 21 which is movable between the engaged position shown on the left-hand side of the drawing to the disengaged position shown on the right-hand side of the drawing at which the movable contact 21 has been retracted downwardly and out of contact with main contact 20.

Main contact 20 has fixed thereto an insulation nozzle 70 which has a central opening therethrough defining a gas flow nozzle of the usual type. Contact 21 also defines a movable cylinder which moves downwardly over an internal stationary piston 60 whereby, during an opening operation, gas will be compressed atop the piston 60 and will rapidly be injected through the interior of the nozzle 70 to produce the usual blast action for interrupting arcs which are produced within the nozzle as will be later described.

A fixed arcing contact assembly 30 is then electrically connected to the terminal 10 and consists of a hollow cylindrical conductive rod 31 having venting openings 33. The bottom of member 31 receives an arcing contact tip 32 formed of a suitable arc-resistant material.

The stationary arcing contact tip 32 cooperates with a movable arcing contact assembly 40 which is the subject of the present invention. The movable arcing contact assembly 40 includes a main elongated tube 41 of conductive material having openings 43 therethrough. Assembly 40 also includes a circular cluster of contact fingers 422 which are engageable with the end of contacts 32 in a butt contact-type configuration. A pressure ring 421 is received in a tapered groove at the bottom of the cluster of fingers 422 to press the cluster outwardly and into sliding contact with the interior diameter of member 41. An arcing ring 423 is then fastened to the upper end of member 41. Note that the interior diameter of member 423 does not engage the outer diameter of member 31 but is spaced therefrom so that there is no friction connection between the member 423 and the stationary arcing assembly.

Pressure ring 421 contains spherical heads 424 which are pressed against the contact fingers 422 under the action of compression spring 50. This causes the fingers to slidably engage the inner wall of support part 41 with good sliding contact pressure. Note further that the contact cluster 422 receives the bottom end of member 423 when member 423 moves downwardly.

The movable arcing assembly consists of two members connected to one another by a lost motion-type connection. The first part of the assembly consists of contact 422 and ring 421. The second part consists of member 41 and ring 423. The lost motion connection consists of contact 422 which can slide along the interior of member 41 between the bottom of ring 423 and the shoulder 41*a*.

During a disconnection operation, member 41 initially moves freely downwardly until the bottom of member 423 engages the surface of contact cluster 422. Thereafter, the components move as a unit to the position shown to the right of the center line of the drawing. Note that during the time member 21 is being moved downwardly, member 41 also moves downwardly since members 41 and 21 are mechanically connected together.

The manner in which the novel puffer interrupter of the drawing operates is described in the following:

Assume, first, that the switch contacts are engaged as shown to the left of the center line of the drawing. In order to separate the contacts, the main contact 21 is first moved downwardly by a suitable operating mechanism (not shown). During this downward motion, it will be noted that nozzle 70 also moves downwardly, thereby to establish the beginning of a strong gas flow through the center of the nozzle and through the region 71 shown to the right of the center line of the drawing.

Once the main contacts 21 and 20 separate, the current through the main contacts commutates into the closed arcing contacts 32 and 422 and a current path is established which includes terminal 10, contact 30, contact tip 32, contact 422, tube 41 and main terminal 11. Member 41 can be electrically connected to terminal 11 through any suitable sliding contact configuration such as one including sliding contact fingers 61 which can be distributed around the periphery of member 41 to establish sliding contact from member 41 to terminal 11.

During the initial part of the motion of member 41, it travels freely and gains speed until member 423 takes up the lost motion and engages the top of the cluster of contact fingers 422. Member 423 will then force the movable contact part 422 to move downwardly at high speed together with member 41. An arc will then be drawn between the contact fingers 422 and the stationary arcing contact 32. The gas flow established by the prior compression of the volume above piston 60 will forcefully flow through the arc drawn between members 422 and 32 and will exhaust into the interior of member 31 and out through the openings 33. Note that the contact fingers 422, as well as the contact 32, define a nozzle-shaped opening so that the arc roots will be intensively blasted by gas coming from the volume being compressed atop the piston 60. The high speed movement of the cool gas will tend to deionize and cool the arc and cause the ultimate interruption of the arc in the usual manner.

The relative arrangement of member 423 and contact fingers 422 is such that the arc will remain on the fingers 422 for a very short time. The arc is then transferred to member 423. This result is achieved by designing the arcing ring 423 such that, after separation of the contact fingers 422 and contact 32, the distance between the arcing contact ring 423 and contact 32 is smaller that the distance between contact fingers 422 and contact 32. This relation is shown to the right of the section line of the drawing.

During the opening operation described above, it will be observed that the force of the compressed spring 50 tends to drive tube 41 downwardly toward the disengaged position during the initial stroke of member 41 before member 423 engages the contact cluster 422. Thus, the spring force assists in producing initial high acceleration of the portion of the movable arcing contact including tube 41 and member 423.

In order to close the puffer interrupter, the movable arcing contact assembly 40 is moved in the opposite direction to that described previously and is moved upwardly. During closing, once the arc contact 423 approaches the fixed contact 32, a pre-arc will appear between these two members. When the contact fingers 422 engage contact 32, however, the closing arc is extinguished. As the assembly moves upwardly, the arcing ring 423 telescopes over the arcing tip 32 and continues its upward movement without an impact against the stationary arcing assembly. Finally, the arcing contact 422 portion engages contact tip 32, but with a relatively small impact.

Since the contact fingers 422 and the pressure ring 421, which presses the contact fingers into sliding engagement with tube 41, are the only parts which engage stationary member 31 during the closing operation and since these parts are of relatively low mass compared with the mass of the entire moving system, and furthermore since these parts are under compression by the spring 50 which is now tensioned, it has been found that there is practically no contact bounce during the closing operation.

Repulsion forces created by the pre-closing arcing current are overcome by the force of the compressed spring 50. After the completion of the connection process, the spring 50 will be charged and is again available for a new disconnection process.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A puffer interrupter comprising, in combination: an elongated stationary arcing contact, a movable arcing contact assembly including first and second relatively movable members and a lost motion connection for connecting said first and second relatively movable members together, and an operating mechanism connected to said first relatively movable member and moving said first member toward and away from said stationary arcing contact; said first and second members slidably electrically connected to one another; said first member moving said second member into engagement with said stationary arcing contact through said lost motion connection whereby, after said second member impacts said stationary arcing contact, said first member continues to travel relative to said stationary arcing contact; said first member including an arcing ring which is spaced from said stationary arcing contact and which arcs to said stationary arcing contact during closing and before said second member impacts with said stationary arcing contact, whereby the mass of the portion of said movable arcing contact assembly which impacts with said stationary arcing contact during closing is reduced to the mass of only said second member to reduce contact closing bounce.

2. The interrupter of claim 1 which further includes spring biasing means connected between said first and second members which normally biases said second member toward engagement with said stationary arcing contact.

3. The interrupter of claim 1 wherein said first member is an elongated hollow tube which at least partly telescopes over said elongated stationary arcing contact during closing, and wherein said second member is slidably disposed within said first member.

4. The interrupter of claim 2 wherein said first member is an elongated hollow tube which at least partly telescopes over said elongated stationary arcing contact during closing, and wherein said second member is slidably disposed within said first member.

5. The device of claim 1, 2, 3 or 4 which further includes cooperable main stationary and main movable contacts electrically and mechanically connected to said stationary arcing contact and said movable arcing contact assembly respectively; said main movable contact having a gas nozzle fixed thereto; said main movable contact and said nozzle being directly connected to said first member whereby, when said second member impacts said stationary arcing contact, said first member and said main movable contact and said nozzle continue to move.

* * * * *